US008038513B2

(12) United States Patent
Roehm

(10) Patent No.: US 8,038,513 B2
(45) Date of Patent: Oct. 18, 2011

(54) MANUAL POWER SANDER, AND VIBRATION ISOLATION DEVICE OF A MANUAL POWER SANDER

(75) Inventor: Heiko Roehm, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 733 days.

(21) Appl. No.: 12/063,455

(22) PCT Filed: Apr. 3, 2007

(86) PCT No.: PCT/EP2007/053203
§ 371 (c)(1),
(2), (4) Date: Feb. 11, 2008

(87) PCT Pub. No.: WO2007/141065
PCT Pub. Date: Dec. 13, 2007

(65) Prior Publication Data

US 2010/0167632 A1 Jul. 1, 2010

(30) Foreign Application Priority Data

Jun. 2, 2006 (DE) ..... 10 2006 025 862
Jul. 24, 2006 (DE) ..... 10 2006 034 078

(51) Int. Cl.
*B24B 27/08* (2006.01)
*B24B 23/03* (2006.01)

(52) U.S. Cl. ..... 451/354; 451/357; 451/359

(58) Field of Classification Search ..... 451/344, 451/354, 355, 356, 357, 358, 359
See application file for complete search history.

(56) References Cited

U.S. PATENT DOCUMENTS

| | | | | |
|---|---|---|---|---|
| 3,322,211 | A * | 5/1967 | Alabuzhev et al. | 173/162.2 |
| 5,361,500 | A * | 11/1994 | Naslund et al. | 30/381 |
| 6,039,639 | A * | 3/2000 | Pfaundler | 451/356 |
| 7,040,972 | B2 | 5/2006 | Hofmann et al. | |
| 7,056,199 | B2 * | 6/2006 | Valentini | 451/357 |
| 7,076,838 | B2 * | 7/2006 | Meixner | 16/431 |
| 7,118,467 | B2 * | 10/2006 | Sun et al. | 451/359 |
| 7,252,156 | B2 * | 8/2007 | Sugiyama et al. | 173/162.1 |
| 7,740,087 | B2 * | 6/2010 | Krondorfer et al. | 173/210 |
| 2003/0132016 | A1 * | 7/2003 | Meixner et al. | 173/162.2 |
| 2005/0170763 | A1 * | 8/2005 | Sun et al. | 451/359 |
| 2006/0219419 | A1 * | 10/2006 | Sugiyama et al. | 173/162.2 |
| 2008/0202784 | A1 * | 8/2008 | Stierle et al. | 173/162.1 |

FOREIGN PATENT DOCUMENTS

| | | |
|---|---|---|
| CN | 1676283 | 10/2005 |
| DE | 102 44 793 | 4/2004 |
| DE | 10 2004 016 171 | 10/2005 |
| EP | 0 849 492 | 6/1998 |

(Continued)

*Primary Examiner* — Timothy V Eley
(74) *Attorney, Agent, or Firm* — Michael J. Striker

(57) ABSTRACT

The invention emanates from a hand-held grinder, in particular an orbital grinder, with at least one handle (10) in or on a housing part (19) and with a drive unit (12) to drive a grinding disc (14) in or on a disc-shaped tool carrier (13) in a housing (11), wherein the grinding disc (14) is on a grinding disc plane (16) and the direction of force (17) is perpendicular to the plane (16) of the grinding disc. The invention proposes that the handle (10) is connected to the housing (11) through at least one vibration decoupling element (18, 71). The invention also relates to a vibration decoupling device of a hand-held grinder.

21 Claims, 4 Drawing Sheets

FOREIGN PATENT DOCUMENTS

| | | |
|---|---|---|
| SU | 716 792 | 2/1980 |
| WO | 94/16864 | 8/1994 |
| WO | 94/19152 | 9/1994 |
| WO | 2007/073981 | 7/2007 |

* cited by examiner

MANUAL POWER SANDER, AND VIBRATION ISOLATION DEVICE OF A MANUAL POWER SANDER

CROSS-REFERENCE TO RELATED APPLICATION

The invention described and claimed hereinbelow is also described in German Patent Applications DE 10 2006 025 862.2 of Jun. 2, 2006 and DE 10 2006 034 078.7 of Jul. 24, 2006. This German Patent Application, whose subject matter is incorporated here by reference, provides the basis for a claim of priority of invention under 35 U.S.C. 119(a)-(d).

BACKGROUND OF THE INVENTION

Hand-guided electric sanders, such as orbital sanders, eccentric sanders, delta sanders and the like, have a tool holder that moves for instance in a circular path in a single plane. In the operation of such hand-guided power sanders, because of the oscillation of the working unit, unpleasant vibration arises, especially in the region of the handle. Such vibration leads to user fatigue sooner and to a lessening of the holding forces. Particularly in long-term operation, a user can be exposed to an increased risk to health. To attain good vibration damping at adequate guiding rigidity, various vibration isolation systems are known in the prior art. Typically, the eccentrically moved mass of the tool holder is brought statically and/or dynamically to a low total imbalance by means of at least one compensatory weight, so as to reduce vibration especially at the handles.

It is furthermore known to increase a mass of the overall product in order to keep the perceptible vibration as slight as possible. A disadvantage here, however, is that working with the hand sander, especially on a wall or overhead, is more difficult because of the great weight.

SUMMARY OF THE INVENTION

In a manual power sander of the invention, in particular an orbital sander, at least one handle is joined to a housing via at least one vibration isolation element. In the housing, there is at least one drive unit for driving a platelike tool holder, in which a sander plate, located in a sander plate plane, is secured. The contact pressure of the tool holder against the workpiece required for the sanding can be initiated by the user via the handle. By varying the contact pressure exerted by the user, the sanding operation can be controlled; with greater contact pressure, the workpiece is machined more intensively, and vice versa. The contact pressure is effected in a force direction that is substantially perpendicular to the sander plate plane. The handle is favorably located above the sander plate plane. Advantageously, by the proposed embodiment, the housing is isolated from the handle, so that unpleasant vibration at the handle can be reduced.

A vibration isolation element according to the invention has intrinsic elasticity, and in a preferred embodiment it is embodied as flectionally elastic. Especially preferably, the vibration isolation element includes a middle part with two lateral pillar elements, located perpendicular to the middle part, and each pillar element can include a plurality of partial pillars. As a result of this embodiment, the flectionally elastic properties can favorably be reinforced. Preferably, at least the pillar elements are formed from a rigid material, such as polyoxymethylene (POM), polyamide 6 (PAG), polycarbonate (PC), steel, or zinc, and the like.

In the unloaded state, the pillar elements are preferably located perpendicular to the sander plate plane and parallel to the force direction. Because of the flectional elasticity of the pillar elements, the receptacles located on the ends are movable relative to one another parallel to the sander plate plane. Because of their special geometric design, the pillar elements are elastic relative to deformation perpendicular to the longitudinal axis of the column, and thus they can favorably compensate for relative motions between the handle on the housing or the rest of the power sander.

In a preferred embodiment, the pillar elements are secured on one free end in receptacles on the handle end of the handle and on another free end they are secured in receptacles on the drive end of the housing. In particular, the pillar elements can be clamped or screwed into the corresponding receptacles, preferably without play.

In an alternative embodiment, the pillar elements may be part of the handle and on one end may for instance be integrally injection-molded onto the handle. With their other free end, the pillar elements can then be secured in receptacles on the drive end of the housing part that includes the handle, preferably being clamped or screwed without play.

In a further alternative embodiment, the pillar elements may be part of the housing on the drive end. For instance, the pillar elements may be injection-molded integrally by one end onto the housing on the drive end and are secured by their other free end in the handle, for instance by means of a clamp connection or screw connection.

It may be provided that in the loaded state, the handle is isolated from the housing in such a way that the pillar elements of the vibration isolation element are put under tensile stress. With increasing contact pressure or increasing tensile stress in the pillar elements, the lateral deflection of the handle relative to the housing is favorably made more difficult, resulting in advantageous isolation. Favorably, the necessary contact pressure for sanding exerted by the user on the handle in the force direction in the connecting components is predominantly a tensile load. With increasing contact pressure on the workpiece, the isolation between the handle and the housing can thus advantageously be reduced, so that at greater loading, guidance of the power sander is improved, and the machinability of the workpiece is facilitated. Despite increasing reaction forces from the interaction between the workpiece and the tool holder, a targeted control over the power sander can thus be ensured. As a result, especially good, defined, precise guidance of the power sander favorably becomes possible, yet at the same time a preferred vibration isolation is also achieved. If the resultant contact pressure exerted by the user is not identical to the axis of rotation of the eccentric, the result can be an uneven tensile load in the vibration isolation elements and thus nonhomogeneous radial isolation, and these compensate for the equally nonuniform sanding reaction forces.

In an alternative embodiment, in the loaded state the handle can also be isolated from the housing in such a way that the pillar elements of the vibration isolation element are put under compressive stress, in order to lessen the isolation between the handle and the housing.

In a further alternative embodiment of the invention, the vibration isolation element is embodied as volumetrically consistent, and in the unloaded state it preferably has a point-symmetrical cross section; the material comprising the elastic, in particular rubber-elastic, vibration isolation element deflects laterally in the loaded state.

Advantageously, the vibration isolation element is embodied as a ring element, such as an O-ring; the ring element is advantageously located in a plane that is parallel to the sander plate plane and may also have a shape other than that of a circular ring, such as an elliptical ring shape. Advantageously, the ring element is retained by means of at least one vibration isolation element receptacle, formed by the housing part and the housing of the drive unit, and the vibration isolation element receptacle in the assembled state of the manual power sander has concentric contact faces for the ring element. These contact faces are advantageously located at least partially parallel to the sander plate plane, so that forces perpendicular to the sander plate plane—axial forces—can be transmitted directly. Expediently, the contact faces are at least partially located at an angle to the sander plate plane, so that even forces parallel to the sander plate plane—radial forces—can be transmitted from the handle to the rest of the power sander. Advantageously, in the unloaded state, the axes of symmetry of the lateral contact faces, located on an angle, and of the ring element coincide. At least one lateral contact face and one contact face parallel to the sander plate plane are located on the housing part and on the housing of the drive unit, respectively. The ring element is clamped between the housing part or the handle on the one hand and the housing of the drive unit on the other. Naturally, a power sander with two ring elements is also conceivable, with each ring located in its own vibration isolation element receptacle. Advantageously, the angle between the contact faces embodied on the housing varies over the circumference, and the diametrically opposed contact faces embodied on the housing part are always oriented parallel to it.

In the loaded state, the handle is isolated from the housing in such a way that the at least one ring element is at least partially put under compressive stress. An axial load leads to a lateral or radial deflection of the material comprising the ring element, making the radial deflection of the handle more difficult. This means that with increasing contact pressure, decreasing isolation and increasing coupling between the handle and the rest of the sander are accomplished.

The radial prestressing extending all the way around, brought about by the ring element, leads to a neutral position of the handle on the rest of the power sander. The handle can swing—quasi-spring-elastically—in a plane parallel to the sander plate plane around the power sander. A radial deflection leads to a contrarily oriented restoring force through the vibration isolation element or the ring element into the neutral outset position. This makes it possible to isolate the handle from the rest of the sander in a plane parallel to the sander plate plane.

If a resultant contact pressure exerted by a user of the power sander is not identical to the center axis of the ring element or of the lateral contact faces, the result is a nonuniform deformation of the ring element and thus a nonuniform radial isolation, which compensates for the equally nonuniform sanding reaction forces.

In the various embodiments, the vibration isolation device of the invention has favorable effects not only on stability and user comfort but also on the guidance and manipulability of the power sander. There are furthermore advantages if the power sander drops unintentionally to the floor, since upon impact on the handle, some of the positional energy is converted into deformation energy of the pillar elements or of the ring element.

It is especially advantageous if both embodiments of the vibration isolation device are realized simultaneously in the same product or manual power sander, or in other words if the vibration isolation device includes at least one pillar element and at least one ring element.

BRIEF DESCRIPTION OF THE DRAWINGS

Further embodiments, aspects, and advantages of the invention, regardless of how they are summarized in the claims, will become apparent without limitation of their general applicability from exemplary embodiments of the invention described below in conjunction with the drawings.

Shown are.

DESCRIPTION OF THE PREFERRED EMBODIMENTS

Figure 1:
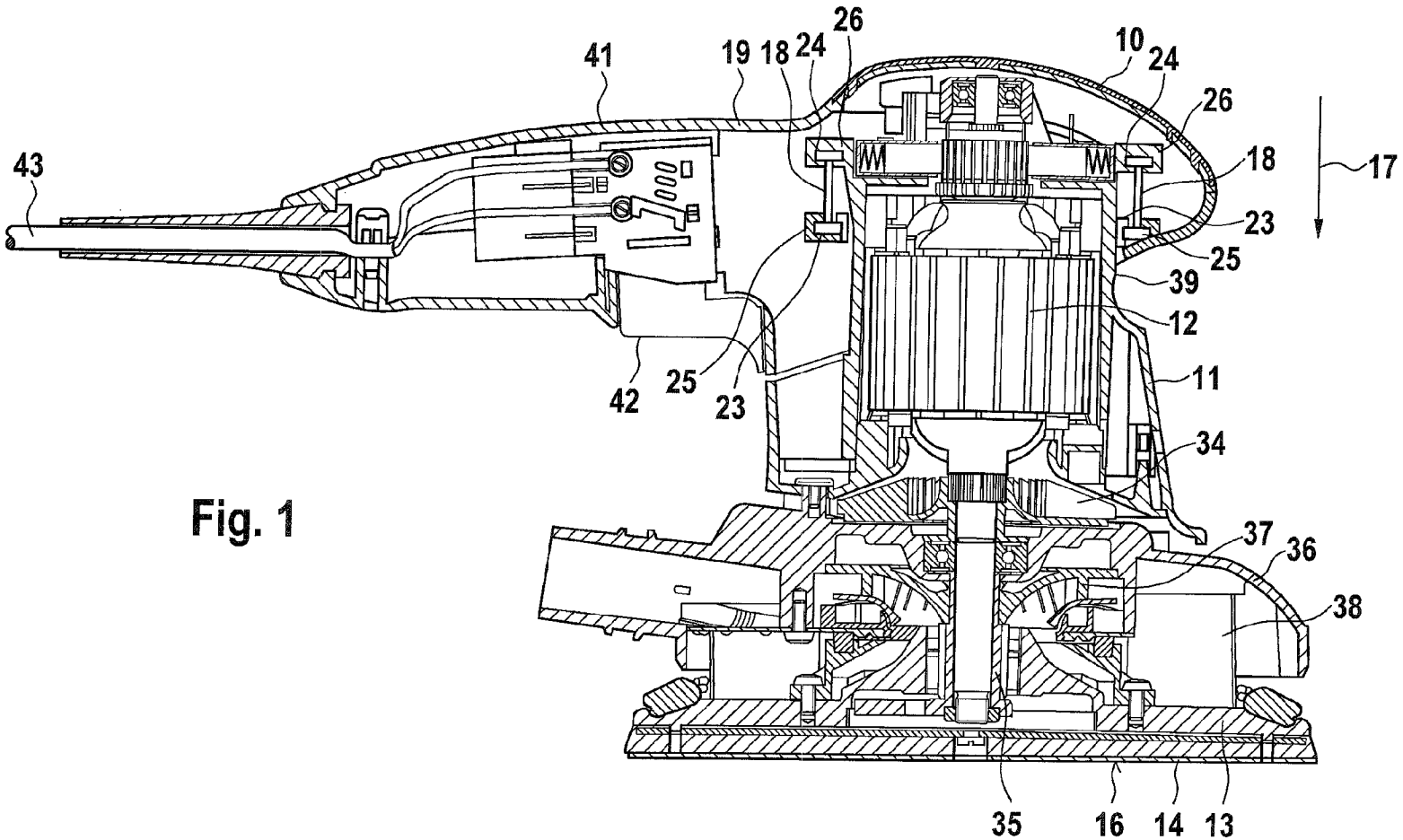
FIG. 1, a first preferred embodiment of a manual power sander of the invention, in section.

Identical elements are identified by the same reference numerals throughout the drawings.

In FIG. 1, a preferred embodiment of a manual power sander is shown, which is embodied as an orbital sander and which has a housing 11, in which in the usual way there is a drive unit 12 of a platelike tool holder 13; the drive unit 12 is connected in terms of force to an eccentric 35. A sander plate 14 is secured in the tool holder 13 and is driven to execute circular motions via the eccentric 35. As the drive unit 12, it is also possible to use a compressed air turbine, a suction turbine, or a DC motor.

A motor fan 34 for ventilating the drive unit 12 is also provided in the housing 11. Between the tool holder 13 and the housing 11, there is an extraction hood 36, in which a dust fan 37 is located. The tool holder 13 is secured to the extraction hood 36 via rocker legs 38. For vibration reduction, a compensatory weight is provided, which is part of the eccentric 35 and is not shown in further detail. In an alternative embodiment, not shown, the compensatory weight may also be part of the dust fan 37.

Above the sander plate plane 16, a handle 10, which comprises a knoblike thickening, is located approximately centrally with respect to the sander plate 14. The requisite contact pressure of the tool holder 13 on the workpiece that is required for grinding can be introduced by the user via the handle 10 and extends along a force direction 17 that is perpendicular to the sander plate plane 16. The handle 10 has a substantially encompassing, groovelike finger depression 39, which furnishes an improved hold for the user's fingers. The combination of the knoblike handle 10 and the finger depression 39 makes for improved manipulation of the power sander. A second grip element 41 is embodied in closed form and serves the purpose of actually holding and guiding the power sander using the other hand. An on/off switch 42 is located below the grip element 41. A cord 43 for supplying electrical power leads out of the second grip element 41.

The housing part 19 that includes both the handle 10 and the grip element 41 and the housing 11 that includes the drive unit 12 are embodied separately from one another and are joined together according to the invention via at least one vibration isolation element 18.

Figure 2:
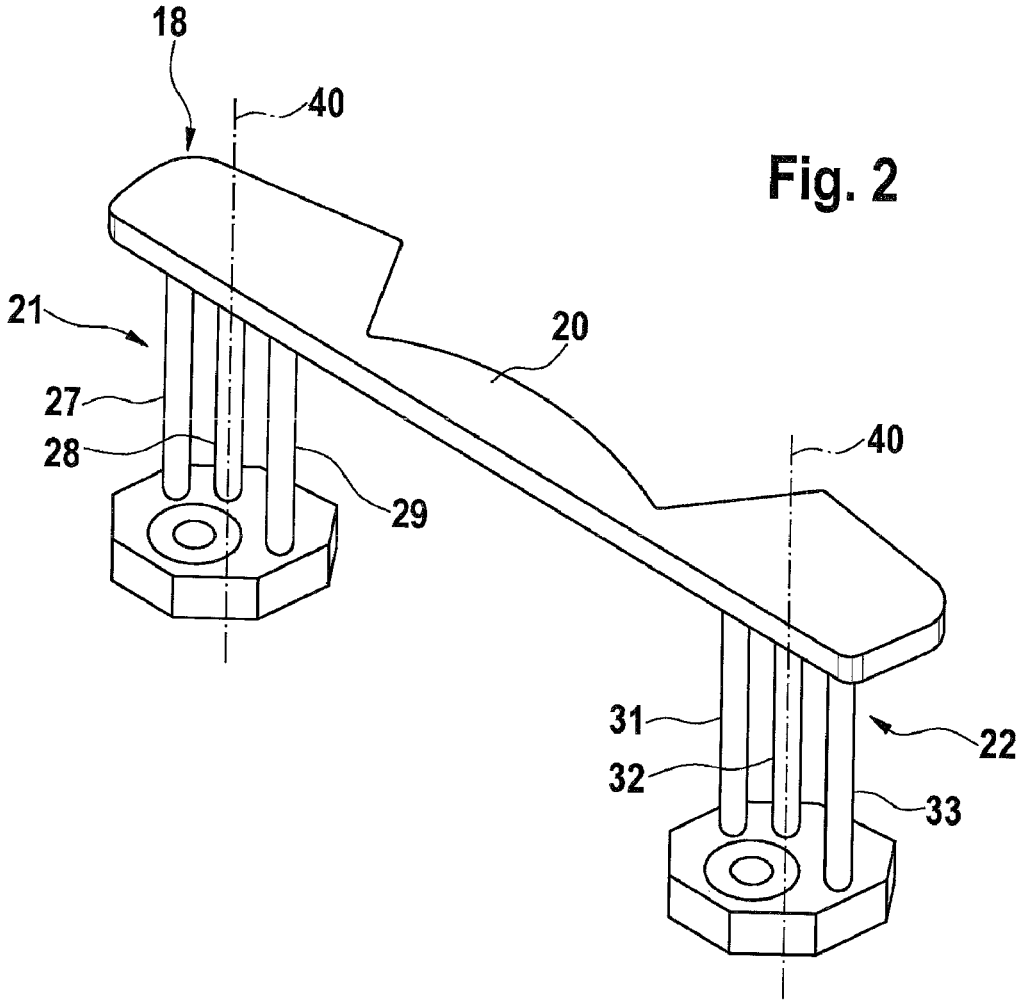
FIG. 2, a detail of a first preferred vibration isolation device of a manual power sander.

The vibration isolation element 18 is shown in detail in FIG. 2. The vibration isolation element 18 includes a middle part 20 with two lateral flectionally elastic pillar elements 21, 22 located perpendicular to the middle part 20. Overall, the vibration isolation element 18 is U-shaped.

The vibration isolation element 18 is expediently formed at least in some regions of a rigid material, such as polyoxymethylene, polyamide 6, polycarbonate, steel, or zinc. The pillar elements 21, 22 each include three partial pillars 27, 28, 29, 31, 32, 33, as a result of which the flectionally elastic properties of the pillar elements 21, 22 are reinforced.

An alternative vibration isolation element 18, not shown, comprises at least one of the partial pillar elements 27, 28, 29, 31, 32, 33.

In FIG. 1, an unloaded state of the manual power sander is shown, in which the pillar elements 21, 22 are located perpendicular to the sander plate plane 16 and parallel the force direction 17. On a free end 23 near the sander plate, the pillar elements 21, 22 are secured in receptacles 25 on the handle end of the handle 10. On a free end 24 remote from the sander plate, the pillar elements 21, 22 can be secured in receptacles 26 on the drive end of the housing 11, particularly via a clamp connection or screw connection.

The pillar elements 21, 22, because of their geometric design, are elastic with respect to deformations perpendicular to the force direction 17, or in other words perpendicular to a longitudinal axis 40 of the pillar elements 21, 22. However, compressive and tensile loads can be transmitted in the longitudinal axis 40 of the columns. The rodlike pillar elements 21, 22, in the unloaded state, are oriented virtually parallel to the force direction 17 and are thus perpendicular to the sander plate plane 16.

If pressure is now exerted on the sander plate 14 in the ON state via the handle 10, 41 in order to initiate the sanding operation, this pressure acts as tensile stress in the pillar elements 21, 22. With increasing tensile stress or increasing contact pressure of the sander plate 14 in the pillar elements 21, 22, the lateral deflection of the handle 10 relative to the housing 11 is made more difficult, thus lessening the isolation of the handle 10 from the rest of the sander. As a result, the housing part 19 of the handle 10, 41 is pulled downward in the force direction 17, and a lateral deflection of the handle 10 relative to the housing 11 is made more difficult. The oscillation amplitude of the handle 10 in the loaded state is thus reduced. Simultaneously, however, the isolation of the handle 10 from the housing 11 and the rest of the power sander is also lessened. This kind of decreasing isolation with increasing sander plate contact pressure results in better guidance and manipulability of the power sander.

Figure 3:
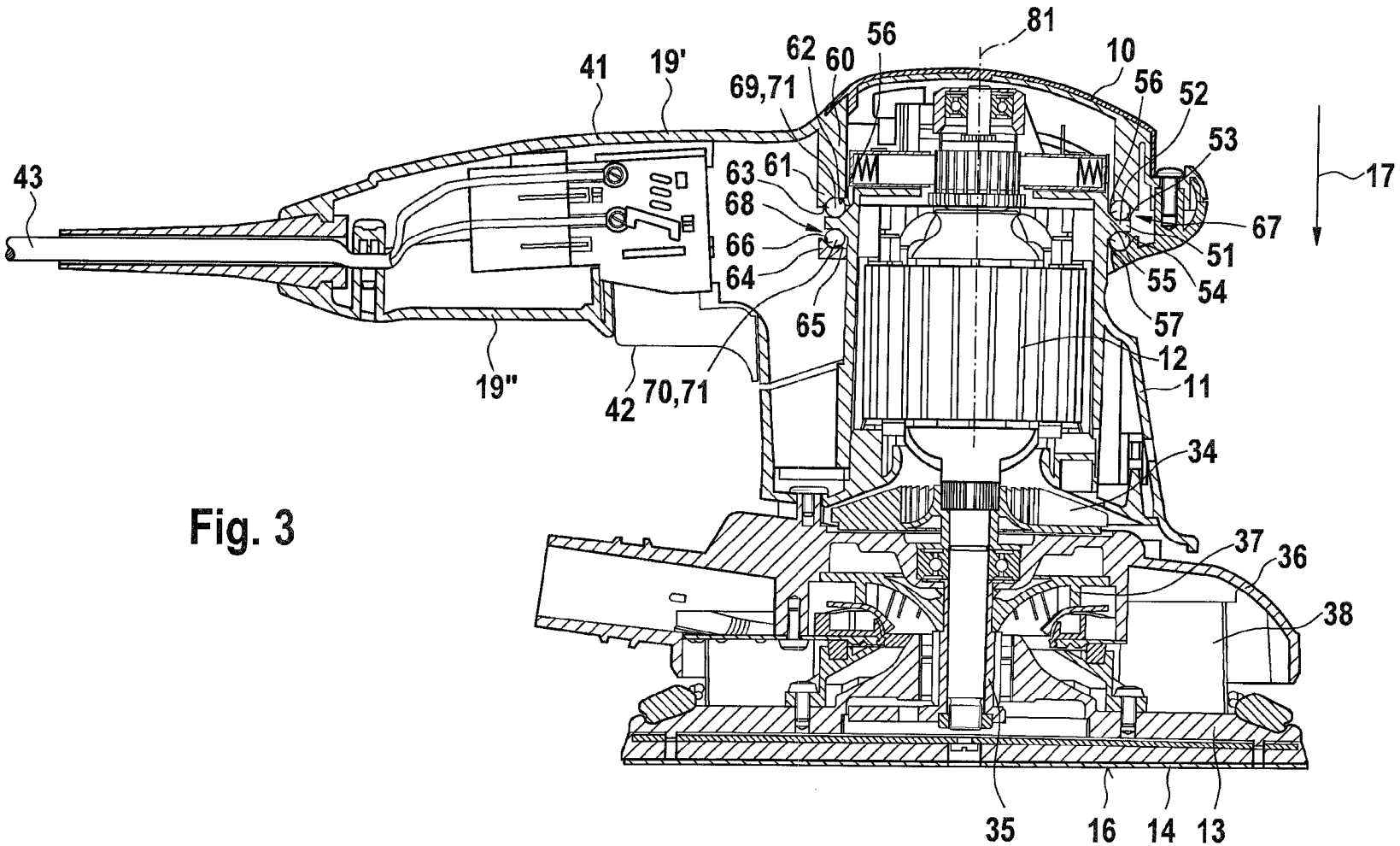
FIG. 3, a second preferred embodiment of a manual power sander of the invention, in section.

FIG. 3 shows a second, preferred exemplary embodiment of a manual power sander embodied as an orbital sander. It is essentially equivalent to the manual power sander of FIG. 1, and it differs from the manual power sander of FIG. 1 in that the vibration isolation provided is designed differently. For that purpose, the housing 11, in its end region near the handle 10, has a radial protrusion 51 extending all way the around, which on its outer region 52 has both an upper contact face 53 and a lower contact face 54, both of them oriented predominantly perpendicular to the force direction 17. In an inner region 55, near the housing 11, the radial protrusion 51 has an upper contact face 56 and a lower contact face 57, which are each oriented at an angle to the contact faces 53 and 54 and merge with them; the inner region 55 has a substantially wedge-shaped cross section that becomes smaller radially outward, with an axis of symmetry oriented parallel to the sander plate plane. In a further advantageous embodiment, the angle between the contact faces 56 and 57 varies over the circumference, with diametrically opposed contact faces 56, 63 and 57, 66 always being oriented parallel to one another.

In the present embodiment, the housing part 19 is split in two, so that it is formed of two housing parts 19' and 19". The housing part 19' has an annular protrusion 60, which on its free end 61 has a contact face 62, which is located parallel and coaxial to the upper contact face 53 of the radial protrusion 51 of the housing 11, and a contact face 63 adjoining it, which merges with the contact face 62 and is located parallel and coaxial to the contact face 56 of the radial protrusion 51 of the housing 11, so that the contact faces 53, 56 and 62, 63 are concentric with and spaced apart from one another. The housing part 19" likewise has a protrusion 64 extending all the way around, on which contact faces 65 and 66 are embodied that are concentric with the contact faces 54 and 57.

The contact faces 53, 56, 62 and 63, and the contact faces 54, 57, 65 and 66 each form a respective vibration isolation element receptacle 67 and 68. An elastic, preferably volumetrically consistent ring element 69 and 70 is located as a vibration isolation element 71 in each of the vibration isolation element receptacles 67, 68, respectively, and has a point-symmetrical, circular cross section. The ring elements 69 and 70, or rings 69 and 70, are clamped between the corresponding housing parts 19' and 19", respectively, and the radial protrusion 51 of the housing 11.

Figure 4:
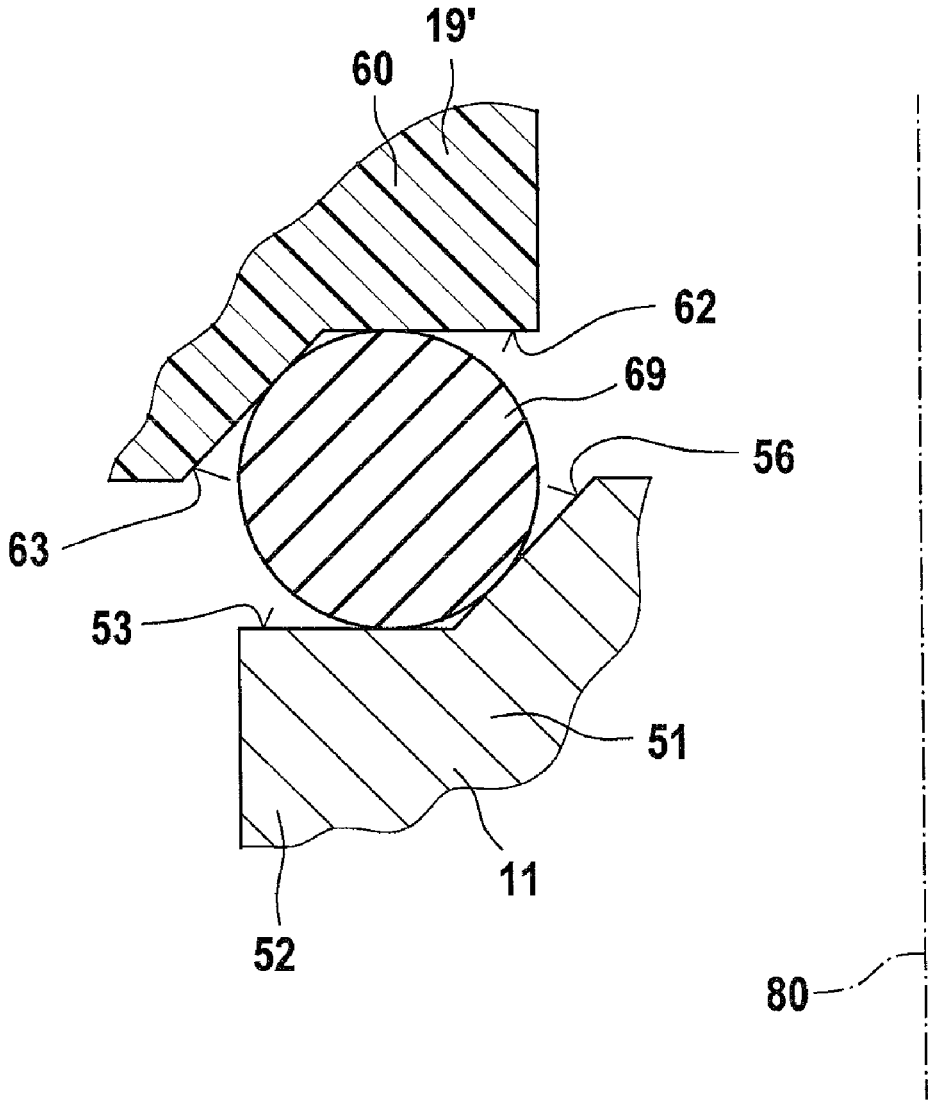
FIG. 4, a fragmentary view of a second preferred vibration isolation device of a manual power sander.

FIG. 4 shows a portion of the vibration isolation device of FIG. 3 in a detail view. The axis 80 is a normal to the sander plate plane 16 and can be identical to the axes 18 of rotation of the drive unit 12 and/or to the axis of symmetry of the ring 69 or of the contact faces 56, 63; the spacing of the contact face 56 from the axis 80 need not be identical at every point, but instead may vary over the circumference. In the neutral state, that is, with the tool not switched on and without forces that act in the direction of the force direction 17, the goal is for the axes of symmetry of the contact faces 56 and 63 and the axis of symmetry of the ring 69 to coincide. This is equally true for the contact faces 57 and 66 and the ring 70, which are not shown here.

During operation, the contact face 62 conducts the contact pressure, originating at the handle 10 and exerted axially or in other words parallel to the force direction 17 onward via the ring 69 to the contact face 53 of the radial protrusion 51 of the housing 11.

The contact face 63 conducts the radial forces, that is, the forces perpendicular to the axis 80, that originate in the handle 10 to the contact face 56 of the radial protrusion 51 of the housing 11 via the ring 69. The contact faces 62 and 53 may for instance be embodied conically also. The contact faces 53, 56, 62 and 63 do not completely enclose the cross section of the ring 69 and do not coincide with the surfaces, facing them, of the ring 69.

By suitable dimensioning of the rings 69 and/or 70 and/or of the vibration isolation element receptacles 67 and 68, a radial prestressing, extending all the way around, of the ring 69 can be attained, which leads to a neutral position of the handle 10 on the rest of the power sander. The handle 10 can thus—quasi-spring-elastically—oscillate in the plane parallel to the sander plate plane 16; a radial deflection leads to an oppositely oriented restoring force through the rings 69 and/or 70 into the neutral outset position. Thus an advantageous isolation of the handle 10 from the rest of the power sander is made possible in a plane parallel to the sander plate plane 16.

An axial load, or in other words in the direction of the force direction 17, leads to a radial expansion of the volume of the ring 69, making a radial deflection of the handle 10 relative to the rest of the power sander more difficult. For an increasing contact pressure, this means a decreasing isolation or an increasing coupling between the handle 10 and the rest of the power sander.

If the resultant direction of the contact pressure exerted by the user is not identical to the axis of symmetry of the ring 69 or 70 and/or of the lateral contact faces 56 and 63 or 57 and 66, the result is unequal reinforcement and thus a nonhomogeneous radial isolation, which compensates for the likewise unequal sanding reaction forces.

This embodiment likewise has the aforementioned advantages in a drop test, since upon impact on the handle 10, some of the positional energy is converted into deformation energy of the ring 69 and/or 70.

Naturally, an advantageous embodiment with a plurality of vibration isolation elements in the form of annular segments or balls is also possible, these elements being located in corresponding vibration isolation element receptacles distributed over the circumference of the housing 11.

Preferably, the rings 69 and/or 70 are made from a material such as polyurethane, isoprene rubber, natural rubber, butadiene rubber, styrene-butadiene rubber, nitrile rubber, butyl rubber, chloroprene rubber, silicone rubber, and/or ethylene-propylene-diene rubber.

The invention claimed is:

1. A manual power sander, having at least one handle located in or on a housing part, and having a drive unit, located in a housing, for driving a sander plate located in or on a platelike tool holder, the sander plate being located in a sander plate plane, and a force direction is located perpendicular to the sander plate plane, wherein the handle (10) is joined to the housing (11) via at least one vibration isolation element (18, 71), wherein the vibration isolation element (18) includes at least one pillar element (21, 22) that in an unloaded state, is located transversely to the sander plate plane (16) or parallel to the force direction, wherein in a loaded state, the handle (10) is isolated from the housing (11) in such a way that the at least one pillar element (21, 22) of the vibration isolation element (18) is put under tensile stress, wherein the at least one pillar element (21, 22) is a component of the housing part (19).

2. The manual power sander as defined by claim 1, wherein the vibration isolation element (18, 71) has intrinsic elasticity.

3. The manual power sander as defined by claim 1, wherein the vibration isolation element (18) is flectionally elastic.

4. The manual power sander as defined by claim 1, wherein the pillar element (21, 22) includes at least one partial pillar (27, 28, 29, 31, 32, 33).

5. The manual power sander as defined by claim 1, wherein the at least one pillar element (21, 22) is capable of being secured on one free end (23) in receptacles (25) on a handle end of the handle (10) and on another free end (24) in receptacles (26) on a drive end of the housing (11).

6. The manual power sander as defined by claim 1, wherein in the loaded state, the handle (10) is isolated from the housing (11) in such a way that the at least one pillar element (21, 22) of the vibration isolation element (18) is put under compressive stress.

7. The manual power sander as defined by claim 1, wherein the vibration isolation element (71) is volumetrically consistent.

8. The manual power sander as defined by claim 1, wherein the vibration isolation element (71) has a point-symmetrical cross section.

9. The manual power sander as defined by claim 1, wherein the vibration isolation element (71) is embodied as a ring element (69, 70).

10. The manual power sander as defined by claim 9, wherein the ring element (69, 70) is located in a plane parallel to the sander plate plane (16).

11. The manual power sander as defined by claim 10, wherein in the loaded state, the handle (10) is isolated from the housing (11) in such a way that the at least one ring element (69, 70) is at least partially put under compressive stress.

12. The manual power sander as defined by claim 1, wherein contact faces (53, 54, 62, 65) are located at least partially parallel to the sander plate plane (16).

13. The manual power sander as defined by claim 1, wherein the contact faces (56, 57, 63, 66) are located at least partially at an angle to the sander plate plane (16).

14. The vibration isolation device as defined by claim 1, wherein the pillar elements (21, 22) each include a plurality of partial pillars (27, 28, 29, 31, 32, 33).

15. The vibration isolation device as defined by claim 1, wherein at least the pillar elements (21, 22) are formed at least partially of a rigid material, such as polyoxymethylene, polyamide 6, polycarbonate, steel, or zinc.

16. The vibration isolation device as defined by claim 1, wherein the vibration isolation element (71) has a point-symmetrical cross section.

17. The vibration isolation device as defined by claim 1, wherein the manual power sander is an orbital sander.

18. A manual power sander, having at least one handle located in or on a housing part, and having a drive unit, located in a housing, for driving a sander plate located in or on a platelike tool holder, the sander plate being located in a sander plate plane, and a force direction is located perpendicular to the sander plate plane, wherein the handle (10) is joined to the housing (11) via at least one vibration isolation element (18, 71), wherein the vibration isolation element (18) includes at least one pillar element (21, 22) that in an unloaded state, is located transversely to the sander plate plane (16) or parallel to the force direction, wherein in a loaded state, the handle (10) is isolated from the housing (11) in such a way that the at least one pillar element (21, 22) of the vibration isolation element (18) is put under tensile stress, wherein the free ends (23, 24) of the pillar element (21, 22) are movable relative to one another parallel to the sander plate plane (16).

19. A manual power sander, having at least one handle located in or on a housing part, and having a drive unit, located in a housing, for driving a sander plate located in or on a platelike tool holder, the sander plate being located in a sander plate plane, and a force direction is located perpendicular to the sander plate plane, wherein the handle (10) is joined to the housing (11) via at least one vibration isolation element (18, 71), wherein the vibration isolation element (18) includes at least one pillar element (21, 22) that in an unloaded state, is located transversely to the sander plate plane (16) or parallel to the force direction, wherein in a loaded state, the handle (10) is isolated from the housing (11) in such a way that the at least one pillar element (21, 22) of the vibration isolation element (18) is put under tensile stress, wherein the at least one pillar element (21, 22) is a component of the housing (11).

20. A manual power sander, having at least one handle located in or on a housing part, and having a drive unit, located in a housing, for driving a sander plate located in or on a platelike tool holder, the sander plate being located in a sander plate plane, and a force direction is located perpendicular to the sander plate plane, wherein the handle (10) is joined to the housing (11) via at least one vibration isolation element (18, 71), wherein the vibration isolation element (18) includes at least one pillar element (21, 22) that in an unloaded state, is located transversely to the sander plate plane (16) or parallel to the force direction, wherein in a loaded state, the handle (10) is isolated from the housing (11) in such a way that the at least one pillar element (21, 22) of the vibration isolation element (18) is put under tensile stress, wherein at least one vibration isolation element receptacle (67, 68) each is formed by the housing part (19', 19") and the housing (11).

21. The manual power sander as defined by claim 20, wherein the vibration isolation element receptacle (67, 68), in an assembled state, has concentric contact faces (53, 54, 56, 57, 62, 63, 65, 66).

* * * * *